United States Patent [19]

Watanabe et al.

[11] 4,188,241

[45] Feb. 12, 1980

[54] METHOD FOR PRODUCING HIGH TENSILE STRENGTH, HIGH DUCTILITY, LOW YIELD RATIO HOT ROLLED STEEL SHEET

[75] Inventors: Kunio Watanabe; Yoshio Hashimoto, both of Sakai, Japan

[73] Assignee: Nippon Steel Corporation, Tokyo, Japan

[21] Appl. No.: 964,889

[22] Filed: Nov. 30, 1978

[30] Foreign Application Priority Data

Dec. 6, 1977 [JP] Japan ..... 52/145705

[51] Int. Cl.[2] ..... C21D 9/46; C21D 9/48

[52] U.S. Cl. ..... 148/12 F; 148/12 C; 148/12.3

[58] Field of Search ..... 148/12 F, 12 R, 12 C, 148/12.3

[56] References Cited

U.S. PATENT DOCUMENTS

| | | | |
|---|---|---|---|
| 3,976,514 | 8/1976 | Matsukura et al. | 148/12 F |
| 4,125,416 | 11/1978 | Katoh et al. | 148/12 F |

*Primary Examiner*—W. Stallard

*Attorney, Agent, or Firm*—Toren, McGeady and Stanger

[57] ABSTRACT

A method for producing a plain low carbon hot rolled steel strip or sheet having a low yield ratio, not higher than 70%, high ductility and high tensile strength comprising: hot rolling a steel slab with its finishing temperature not lower than the $Ar_3$ transformation temperature, cooling the hot rolled strip from a temperature not lower than $Ar_3$ transformation temperature and coiling the hot rolled strip at a temperature not higher than 300° C.

6 Claims, 1 Drawing Figure

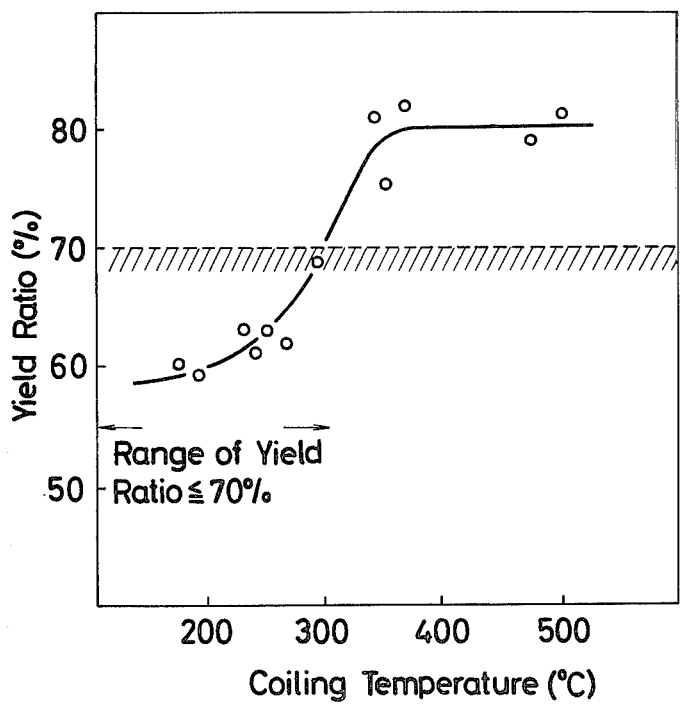
80
70
60
50
Yield Ratio (%)
Range of Yield
Ratio ≦ 70%
200
300
400
500
Coiling Temperature (°C)

METHOD FOR PRODUCING HIGH TENSILE STRENGTH, HIGH DUCTILITY, LOW YIELD RATIO HOT ROLLED STEEL SHEET

BACKGROUND OF THE INVENTION

1. Field of the Invention

The present invention relates to a method for producing a hot rolled steel sheet or strip having high tensile strength, high ductility and low yield ratio.

Conventionally, high tensile strength steels have mostly been used as structural thick gauge steel plate, but in recent years in various industries, such as the automobiles, railways and industrial machines. The increasing tendency is that the hot rolled high tensile strength steel sheet is used more and more for the purpose of weight-savings and cost reduction. However, in the fields of industry where a relatively thin gauge high tensile strength steel sheet is used, the steel sheet is very often press-formed. Therefore, conventional high tensile strength steels, having a high yield strength, hence a high yield ratio, have been confronted with various problems such that they can not be severely worked due to their low ductility, that accuracy in the formed articles produced from these materials is often unsatisfactory due to their spring-back phenomena after their deformation, and that wearing of tools is substantial and dies are easily worn due to their high yield strength.

Thus increasing demands have been made among various users for development of a low yield ratio but high tensile strength steel sheet which shows a high degree of work hardening and a satisfactorily high yield point, or yield strength after press-forming.

2. Description of Prior Art

A typical low yield ratio, high tensile strength steel sheet which has been demanded in the above fields of industries must show a tensile strength not lower than 50 kg/mm$^2$ and a yield ratio not higher than 70% as well as excellent ductility in the case of a thin gauge steel sheet, for example, of thickness of 4 mm or less. Steel materials suitable for producing such a steel sheet as above include a bainite steel. This bainite steel, as well known, is a high strength steel utilizing the high strength of the bainite which is a decomposition product of austenite at low temperatures.

For rolling this bainite steel by means of an ordinary hot strip mill, it is necessary to increase the manganese content and add elements, such as Ni, Cr and Mo, in addition to the precipitation hardening elements, such as Nb, V and Ti, in order to improve the hardening. Therefore, the production cost is inevitably increased due to the additional elements so that this steel material has been confronted with disadvantages when it is used as automobile steel sheets which must be produced at a low production cost.

Also, the carbide and nitride forming elements, such as Nb, V and Ti, which are added in the conventional high tensile strength steels for the purpose of improving the strength and toughness are undesirable because they increase the yield ratio, usually 80% or higher.

Meanwhile trials have been proposed to lower the yield ratio by annealing the hot rolled steel coil at a temperature higher than the transformation temperature in a heat treating equipment, such as a continuous annealing line, and rapidly cooling the coil. However, this process requires a separate process of heat treatment, thus increasing the production cost.

SUMMARY OF THE INVENTION

Therefore, one of the objects of the present invention is to overcome the various disadvantages of the prior art and to provide a method for producing a low yield ratio, hot rolled, high tensile strength steel sheet at a low production cost.

In recent years, the capacity of a coiler in the hot strip mill has been increased so that a hot rolled sheet of up to about 25 mm in thickness can be satisfactorily coiled. However, the present invention is advantageous for production of a hot rolled sheet of up to about 6 mm in thickness from the point of the final applications.

The method according to the present invention comprises hot rolling a plain low carbon steel sheet or strip with its finishing temperature not lower than the $Ar_3$ transformation temperature, cooling the hot rolled strip from a temperature not lower than $Ar_3$ transformation temperature, and coiling the hot rolled strip at a temperature not higher than 300° C.

When a steel sheet of more than 4 mm thickness is to be produced, the method of the present invention may be modified in such a way that the finishing temperature of the rolling is limited to the range from the $Ar_3$ point to the $Ar_3$ point +40° C.

The present invention is applicable to ordinary rimmed and killed plain low carbon steels and particularly the following steel composition is preferable, 0.05 to 0.15% C, not larger than 0.70% Si, 0.50 to 2.00% Mn with the balance being iron and unavoidable impurities.

For further improvements in the bending property and the stretch-flange-formability, the present invention may further be modified. This modification comprises hot rolling a steel comprising 0.05 to 0.15% C, not more than 0.70% Si, 0.50 to 2.00% Mn, not more than 0.015% S, Zr in an amount satisfying the condition of $2 \leqq Zr/S \leqq 10$ or one or more of rare earth metals (REM) in an amount satisfying the condition $1.3 \leqq REM/S \leqq 5$ with the balance being iron and unavoidable impurities with its finishing temperature not lower than the $Ar_3$ transformation temperature, cooling the hot rolled strip from a temperature not lower than $Ar_3$ point and coiling the hot rolled strip at a temperature not higher than 300° C., so as to obtain a low yield ratio, high strength hot rolled steel sheet with a yield ratio not higher than 70%.

DETAILED DESCRIPTION OF THE INVENTION

The present invention will be described in more detail referring to the attached drawing.

BRIEF EXPLANATION OF THE DRAWING

The attached drawing is a graph showing the relation between the coiling temperature and the yield ratio observed in a hot rolled thin gauge steel strip (2.0 mm thick) having the composition:

| C | Si | Mn | S | Al |
|---|---|---|---|---|
| 0.10 | 0.25 | 1.40 | 0.006 | 0.025 (wt. %) |

Reasons for various limitations in the present invention will be explained below.

Carbon contents beyond 0.15% lower the formability and weldability, and on the other hand, carbon contents below 0.05% do not provide the desired strength.

Therefore, the carbon content is defined to the range from 0.05 to 0.15% in the present invention.

Silicon is useful for deoxidation and improvement of strength and may be added up to 0.70% beyond which it deteriorates the weldability.

In the present invention, the silicon content is limited to not more than 0.70%, but when the silicon is contained more than 0.70%, the upper limit of the coiling temperature required for obtaining the desired low yield ratio can be raised, because enrichment of carbon is accelerated in the austenite by the presence of silicon so that the dual phase structure can be easily obtained.

Manganese is essential in the present invention and its content may be changed according to the level of strength to be finally obtained. However, below 0.50%, it can not produce a micro-structure required for the desired strength and lowered yield ratio, and beyond 2.00%, it damages the ductility and weldability. Thus the manganese content is defined to the range from 0.50 to 2.00% in the present invention.

For avoiding the severe deterioration of bending, elongation and stretch-flange-formability due to inclusions elongated in the rolling direction, the sulfur content is limited so as to reduce the MnS inclusion and to save the addition of Zr and REM in the modification of the present invention.

The amounts of Zr and REM (namely La and Ce) which are added in correlation with sulfur to control the shape of sulfides vary depending on their affinity with oxygen, nitrogen, etc., and the ranges of $2 \leqq Zr/S \leqq 10$ and $1.3 \leqq REM/S \leqq 5$ are appropriate. The lower limits of these ranges represent the minimum amounts required for converting MnS into a REM or Zr sulfide composition which is not easily deformed plastically by the hot working, and the upper limits of these ranges represent the amounts beyond which the effects by these elements of improving the shape of the sulfides are saturated, and oxide inclusions increase to lower the workability.

The steel of the above composition may be prepared by an ordinary steel making method and the steel may be processed into slabs by ingot making and then breaking down, or by continuous casting.

Then, the rolling conditions defined in the present invention will be described.

The slab may be heated in an ordinary slab heating furnace and then rolled, or the broken down material may be directly hot rolled. In either case, there is no limitation in the heating temperature from the consideration of solid solution of carbo-nitrides because additional elements, such as Nb and V are not required. Also there is no limitation on the starting temperature of the rolling, and it may be a minimum temperature determined from the required finishing temperature of the rolling which is defined to be not lower than the $Ar_3$ transformation temperature.

When a relatively thin high tensile strength steel sheet, for example, of 4 mm or less in thickness is to be produced according to the present invention, the limitation of the finishing temperature to a temperature not lower than the $Ar_3$ point is essential for refining the austenite grains to control the hardenability of the steel and is essential for the subsequent cooling, which is started at a temperature not lower than the $Ar_3$ point to obtain the desired micro-structure of the present invention.

Thus in the case of the relatively thin steel sheet, the reduction required in the ordinary rolling step is about 95% or larger, and the finishing temperature of the rolling is relatively low so that the austenite grains are refined. When the refined austenite grains are further rolled at low temperatures and then the strip is rapidly cooled and coiled at low temperatures as described below, a highly ductile sheet containing a larger amount of fine proeutectoid ferrite is obtained.

Detailed descriptions will be made in this point.

When the hot rolled sheet is cooled immediately after the rolling, namely from a temperature not lower than the $Ar_3$ point, the carbon concentration in the austenite is relatively low at the initial stage of cooling, the strain has been introduced during rolling so that the ferrite transformation is accelerated because of lower hardenability of the steel. Along with the precipitation of ferrite, the carbon concentration in the retained austenite increases, thus increasing the hardenability. Therefore, even if the cooling rate is not increased during the transformation, when the coiling temperature is low enough, the retained austenite transforms into bainite or martensite.

When a starting temperature of rapid cooling is below the $Ar_3$ point, so that $\alpha$-$\gamma$ transformation takes place too excessively, the ratio of the secondary phase (the phase transformed at low temperature) is lowered which is necessary for the desirable strength and low yield ratio.

In the case of a thicker steel sheet, the general the austenite grains will not be satisfactorily refined by rolling at high finishing temperature, and it is difficult to obtain a satisfactory ductility, although the yield ratio can be lowered, by the subsequent low temperature coiling.

Therefore, in the case of a thick steel sheet (thicker than 4 mm) the finishing temperature of the hot rolling is limited to the range from the $Ar_3$ point to the $Ar_3$ +40° C. This limitation is made to refine the austenite grains, thus controlling the hardenability, and to obtain the desired micro-structure suitable for the objects of the present invention.

In this case, however, when the finishing temperature exceeds the $Ar_3$+40° C., the austenite grains at the final rolling stage can not be satisfactorily refined, and if they are rapidly cooled directly after the rolling, a coarse grained bainite or martensite is developed which lowers formability.

When the finishing temperature of the rolling is below the $Ar_3$ point, the proeutectoid ferrite is worked, and both the recovered structure and the deformed structure show an increased yield point and deterioration of formability so that the desired mechanical properties can not be obtained.

Therefore, the $Ar_3$ point is the lower limit of the finishing temperature of the rolling in the present invention.

The reason why the coiling temperature is defined to be 300° C. or lower is clearly illustrated in the attached drawing. The highest coiling temperatuure for assuring a yield ratio not higher than 70% is 300° C., beyond when the ferrite-pearlite transformation takes place so that the desired low yield ratio can not be obtained. On the other hand, when the coiling temperature is below 300° C., a micro-structure mixed with the proeutectoid ferrite which precipitates during the cooling stage and the bainite or martensite finally transformed from the austenite in an appropriate proportion can be obtained, so that the desired levels of strength and yield ratio can be obtained.

DESCRIPTION OF PREFERRED EMBODIMENTS

The present invention will be more clearly understood from the following embodiments (thin steel sheets).

The steel slabs having the compositions shown in Table 1 which were prepared by melting in a converter, ingot making and break down rolling were rolled to 2.0 mm thickness by a hot strip mill under the rolling conditions, and cooled and coiled as shown in Table 1. The rolling conditions represent the difference (FT-$Ar_3$) between the finishing temperature (FT) at the outlet and the $Ar_3$ transformation temperature.

In Table 1, the steels A–E, represent Al—Si killed steels, and the steels F–G represent Si killed steels.

The mechanical properties of the resultant steel sheets are shown in Table 2. The tension tests were done using No. 5 testpieces (transverse direction) according to JIS Z2001, the bending tests were done using testpieces (transverse direction) of 150 mm wide (edges were as sheared), and the bore expansion tests were done using testpieces with a punched-hole of 20 mm in diameter. The limit bending radius in the bending tests was defined to be the minimum bending radius at which the length of the crack is 10% or less of the width of the testpiece when bent 180°. The press formability tests were done with a blank diameter of 200 mm, a punch diameter of 30 mm and a force of 60 ton.

The steels A, B and C are within the scope of the present invention in respect to the chemical composition and the rolling condition as well as the coiling temperature, and show a high tensile strength, a low yield ratio and excellent elongation and stretchability. The steels B and C, in particular, show marked improvements in the bending property, elongation and stretch flange formability due to the additions of Zr and REM.

Meanwhile, the steel D satisfies the requirements of the composition and the finishing temperature of the rolling according to the present invention, but the coiling temperature is higher than 300° C., so that this steel does not provide the low yield ratio inherent to the present invention and shows only a tensile strength lower than that of the same steel composition treated according to the present invention.

The steel E is outside the range of the finishing temperature defined in the present invention, and this steel also shows a high yield ratio and a lowered ductility.

The steels F and H, which are both within the scope of the present invention, but the steel G which was coiled at a higher temperature shows a higher yield ratio and remarkable deterioration of ductility.

The results obtainable by the present invention will be described hereinbelow in connection with thick steel sheets of 4 mm or thicker in thickness.

Steel slabs prepared by melting in a converter, ingot making and break down rolling were rolled into steel sheets of 4.5 mm thickness by a hot strip mill, cooled and coiled. The chemical compositions of the steels, the rolling and cooling conditions and the coiling temperatures are shown in Table 3 in the same way as in Table 1.

The steels in Table 3, A'–C' and G' are within the scope of the present invention and the steels D'–F' are comparative steels.

The results of the mechanical tests conducted on the steel sheets as shown in Table 3 are shown in Table 4. The tension tests were done using No. 5 testpieces (C direction) according to JIS Z2201, the bending tests were done using test-pieces (transverse direction) of 150 mm wide (edges were as sheared). The limit bending radius in the bending tests was defined to be the minimum bending radius at which the length of the crack is 10% or less of the width of the testpiece when bent 180°.

The steels A', B', C', and G' are within the scope of the present invention in respect to the steel composition and the rolling condition, and thus show a high tensile strength, a low yield ratio and excellent cold formability. The steels B' and C', in particular, show excellent bending property due to the addition of Zr and REM.

Meanwhile, the steel D' was rolled within the range of the finishing rolling temperature defined in the present invention, but was coiled at a temperature higher than the coiling temperature defined in the present invention, and thus can provide only a tensile strength lower than that of the same steel composition treated by the present invention. The steel E', which is the same composition as the steel A', also shows increased yield strength and lowered cold formability on the basis of the same strength, due to its finishing temperature below the $Ar_3$ point.

The steel F' having the same composition as the steel C' shows the same level of tensile strength as the steel C', but shows an increased yield ratio and a lowered ductility due to its finishing temperature higher than the range defined in the present invention.

As described above, the present invention can produce at low production cost a steel sheet having high strength and low yield ratio, particularly suitable for cold working and can be advantageously adapted to a hot strip mill in particular.

Table 1

| Steel | | Chemical Composition (wt. %) C | Si | Mn | S | Al | Zr | REM | Rolling Condition (°C.) FT:Finishing Temperature FT-$Ar_3$ | Cooling Condition (°C.) Starting Temperature ST-$Ar_3$ | Coiling Temperature: CT (°C.) |
|---|---|---|---|---|---|---|---|---|---|---|---|
| A | Present Invention | 0.10 | 0.25 | 1.40 | 0.006 | 0.025 | — | — | 20 | 10 | 240 |
| B | Present Invention | " | " | " | " | " | 0.04 | — | 15 | 5 | 265 |
| C | Present Invention | " | " | " | " | " | — | Ce 0.010 | 30 | 10 | 250 |
| D | Comparative | " | " | " | " | " | — | " | 35 | 25 | 340 |
| E | " | " | " | " | " | " | 0.04 | — | −10 | −20 | 280 |
| F | Present Invention | 0.13 | 0.30 | 1.25 | 0.011 | 0.003 | — | — | 20 | 10 | 230 |
| G | Comparative | " | " | " | " | " | — | — | 25 | 15 | 350 |
| H | Present | " | " | " | " | " | — | — | 20 | 10 | 150 |

Table 1-continued

| Steel | Chemical Composition (wt. %) C | Si | Mn | S | Al | Zr | REM | Rolling Condition (°C.) FT:Finishing Temperature FT-Ar3 | Cooling Condition (°C.) Starting Temperature ST-Ar3 | Coiling Temperature: CT (°C.) |
|---|---|---|---|---|---|---|---|---|---|---|
| Invention | | | | | | | | | | |

Table 2

| Steel | Tension Test (C Direction) Yield Strength or 0.2% Proof Stress (kg/mm²) | Tensile Strength (kg/mm²) | Yield Ratio (%) | Elongation (%) | Bending Test (Limit Bending Radius) (Thickness) | Bore Expansion Test Stretch Flange Test | Stretchability Test Height formed by Press Stretching (mm) |
|---|---|---|---|---|---|---|---|
| A | 41 | 66 | 61 | 27 | 0.5 | 1.32 | 40.0 |
| B | 40 | 63 | 62 | 28 | 0 | 1.40 | 42.0 |
| C | 41 | 65 | 63 | 29 | 0 | 1.42 | 42.5 |
| D | 46 | 60 | 77 | 28 | 0 | 1.55 | 38.0 |
| E | 48 | 59 | 82 | 27 | 0 | 1.50 | 37.5 |
| F | 39 | 62 | 63 | 27 | 1.0 | 1.30 | 39.5 |
| G | 44 | 59 | 75 | 24 | 1.5 | 1.25 | 37.0 |
| H | 41 | 67 | 61 | 24 | 1.0 | 1.25 | 39.0 |

Table 3

| Steel | Chemical Composition (wt. %) C | Si | Mn | S | Al | Zr | REM | Rolling Condition FT-Ar3(°C.) | Starting Temperature of Cooling Ar3 | Coiling Temperature (°C.) |
|---|---|---|---|---|---|---|---|---|---|---|
| A' Present Invention | 0.12 | 0.28 | 1.53 | 0.007 | 0.016 | — | — | 20 | 10 | 250 |
| B' Present Invention | " | " | " | " | " | 0.05 | — | 5 | 0 | 240 |
| C' Present Invention | " | " | " | " | " | — | Ce 0.012 | 25 | 15 | 270 |
| D' Comparative | " | " | " | " | " | 0.05 | — | 30 | 20 | 350 |
| E' " | " | " | " | " | " | — | — | −15 | −25 | 220 |
| F' " | " | " | " | " | " | — | Ce 0.012 | 60 | 50 | 280 |
| G' Present Invention | " | " | " | " | " | — | — | 20 | 10 | 150 |

Table 4

| Steel | Tension Test Yield Point (kg/mm²) | Tensile Strength (kg/mm²) | Yield Ratio (%) | Elongation (%) | Bending Test Limit Bending Radius Thickness |
|---|---|---|---|---|---|
| A' | 43 | 68 | 63 | 31 | 0.5 |
| B' | 46 | 73 | 63 | 32 | 0 |
| C' | 45 | 70 | 64 | 33 | 0 |
| D' | 48 | 61 | 79 | 28 | 0.5 |
| E' | 55 | 72 | 76 | 26 | 1.0 |
| F' | 50 | 70 | 71 | 27 | 0.5 |
| G' | 44 | 70 | 63 | 30 | 0.5 |

What is claimed is:

1. A method for producing a plain low carbon hot rolled steel strip or sheet having a low yield ratio, not higher than 70%, high ductility and high tensile strength comprising: hot rolling a steel slab with its finishing temperature not lower than the $Ar_3$ transformation temperature, cooling the hot rolled sheet strip from a starting temperature not lower than $Ar_3$ transformation temperature, and coiling the hot rolled strip at a temperature not higher than 300° C.

2. A method according to claim 1, in which the finishing temperature of the hot rolling is in the range from the $Ar_3$ temperature to the $Ar_3$ point +40° C.

3. A method according to claim 1, in which the steel slab comprising 0.05 to 0.15% C, not larger than 0.70% Si, 0.50 to 2.00% Mn with the balance being iron and unavoidable impurities.

4. A method according to claim 1, in which the steel slab comprises 0.05 to 0.15% C, not more than 0.70% Si, 0.50 to 2.00% Mn, not more than 0.015% S, Zr in an amount satisfying the condition of $2 \leqq Zr/S \leqq 10$ or one or more of rare earth metals (REM) in an amount satisfying the condition $1.3 \leqq REM/S \leqq 5$ with the balance being iron and unavoidable impurities.

5. A method according to claim 2, in which the steel slab comprising 0.05 to 0.15% C, not larger than 0.70% Si, 0.50 to 2.00% Mn with the balance being iron and unavoidable impurities.

6. A method according to claim 2, in which the steel slab comprises 0.05 to 0.15% C, not more than 0.70% Si, 0.50 to 2.00% Mn, not more than 0.015% S, Zr in an amount satisfying the condition of $2 \leqq Zr/S \leqq 10$ or one or more of rare earth metals (REM) in an amount satisfying the condition $1.3 \leqq REM/S \leqq 5$ with the balance being iron and unavoidable impurities.

* * * * *